US006718997B2

(12) United States Patent
Biszko

(10) Patent No.: US 6,718,997 B2
(45) Date of Patent: Apr. 13, 2004

(54) METERING AND PRESSURE REDUCTION PIPING SYSTEM

(75) Inventor: Raymond Biszko, Tiverton, RI (US)

(73) Assignee: Trigen Boston Energy Corporation, Boston, MA (US)

( * ) Notice: Subject to any disclaimer, the term of this patent is extended or adjusted under 35 U.S.C. 154(b) by 2 days.

(21) Appl. No.: 10/191,005

(22) Filed: Jul. 8, 2002

(65) Prior Publication Data

US 2004/0003845 A1 Jan. 8, 2004

(51) Int. Cl.[7] ..... F17D 1/20

(52) U.S. Cl. ..... 137/1; 137/269; 137/343; 137/561 R

(58) Field of Search ..... 137/269–343, 137/561 R

(56) References Cited

U.S. PATENT DOCUMENTS

| | | | | | |
|---|---|---|---|---|---|
| 1,459,666 | A | | 6/1923 | Adams | |
| 2,690,077 | A | | 9/1954 | Lisenbee | |
| 2,881,012 | A | | 4/1959 | Rings | |
| 2,994,339 | A | * | 8/1961 | Massey | 137/561 R |
| 3,048,372 | A | * | 8/1962 | Newton, Jr. | 137/561 R |
| 3,111,030 | A | | 11/1963 | Whitman | |
| 3,423,988 | A | * | 1/1969 | Grove et al. | 73/1.17 |
| 4,091,840 | A | * | 5/1978 | Grove et al. | 137/269 |
| 4,245,412 | A | | 1/1981 | Schabert et al. | |
| 4,872,355 | A | | 10/1989 | Rohrberg et al. | |
| 5,176,177 | A | | 1/1993 | Rupp | |
| 5,324,111 | A | | 6/1994 | Hasegawa | |
| 5,654,505 | A | | 8/1997 | Jiles | |
| 6,011,826 | A | | 1/2000 | Conrads et al. | |
| 6,635,172 | B2 | * | 10/2003 | Newman | 137/561 R |

* cited by examiner

*Primary Examiner*—Kevin Lee
(74) *Attorney, Agent, or Firm*—Weingarten, Schurgin, Gagnebin & Lebovici LLP

(57) ABSTRACT

A metering and pressure reduction piping system is prefabricated with backbone piping supported by a frame and a plurality of spool pieces that are interchanged at the site with selected metering and valve sections. The interchangeable piping sections having a common length and are connectable to the backbone piping via standardized interface flanges.

29 Claims, 10 Drawing Sheets

METERING AND PRESSURE REDUCTION PIPING SYSTEM

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

In many places, steam generated at a generating plant is distributed through a steam piping system to individual customer sites for purposes such as heating a building or generating hot water. The metering and delivery of district steam to a site typically involves a custom design and installation of specific piping at the site to match the individual energy needs of the customer. This process begins with an estimation of energy consumption at the site. For the case of steam, energy consumption is formulated as a flowrate. A flowrate is the mass flow of a product, such as steam, through a device.

To meter this flowrate, a particular meter is selected, both in terms of size and manufacturer. Once this selection is made, a piping configuration is designed to match the meter selection and fabricated at the site. Using the same energy consumption and flowrate data, particular pressure reduction components are selected to reduce the pressure from the higher pressure in the distribution system piping to the appropriate lower pressure at the site. This selection allows a custom piping design to be completed, the piping fabricated, and installed at the site.

This process results in a permanent piping system, which offers little flexibility should the energy consumption vary or the design parameters change. If meters and/or pressure reducing valves need to be replaced, equipment from the same manufacturer and of the same size must be used or significant modifications to the permanent piping must be made.

SUMMARY OF THE INVENTION

The present invention relates to a prefabricated metering and pressure reduction piping system suitable for the distribution of district steam or other fluids at an individual site. The piping system includes backbone piping mounted on a frame and interchangeable, configurable piping sections that are attachable between sections of the backbone piping within the frame. The backbone piping and the frame remain unchanged regardless of the application and the configurable piping sections inserted therein. At the factory, the configurable piping sections are provided as standardized spool pieces. The spool pieces are replaced with the desired piping sections at the site.

The desired piping sections for the site are formed of the selected components, typically a flowmeter and one or more pressure reducing valves, inserted between upstream and downstream lengths of pipe that terminate with standardized or common interface flanges. The piping sections are the same length as the standardized spool pieces and connect to the backbone piping with the standardized interface flanges, allowing the use of any selected make, size, and configuration of meter or pressure reducing valve in the system.

The piping system of the present invention results in reduced costs and faster and simpler installation. Quality is increased because higher tolerances can be achieved in the factory than in the field. The system provides a flexible, efficient, and high quality prefabricated alternative to standard, field fabricated piping systems.

DESCRIPTION OF THE DRAWINGS

The invention will be more fully understood from the following detailed description taken in conjunction with the accompanying drawings in which.

DETAILED DESCRIPTION OF THE INVENTION

Figure 1:
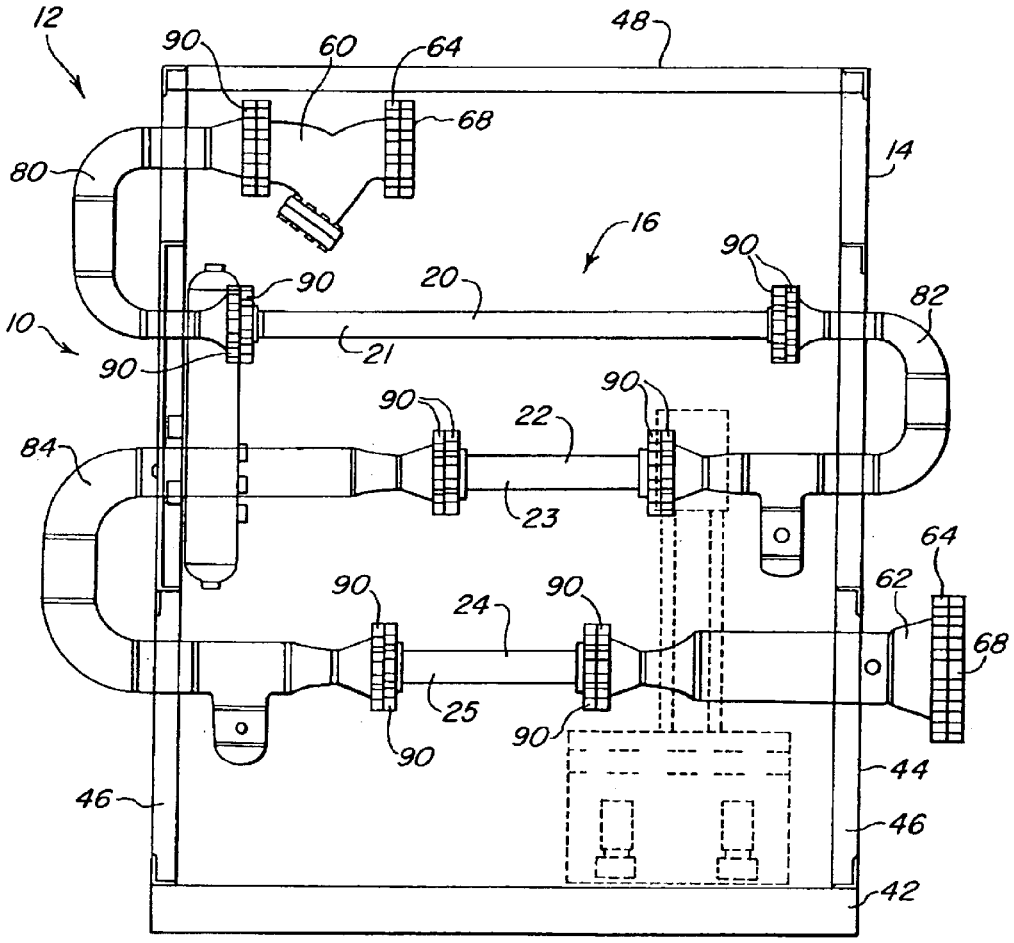
FIG. 1 is a front view of a piping system with spool pieces according to the present invention.
Figure 2:
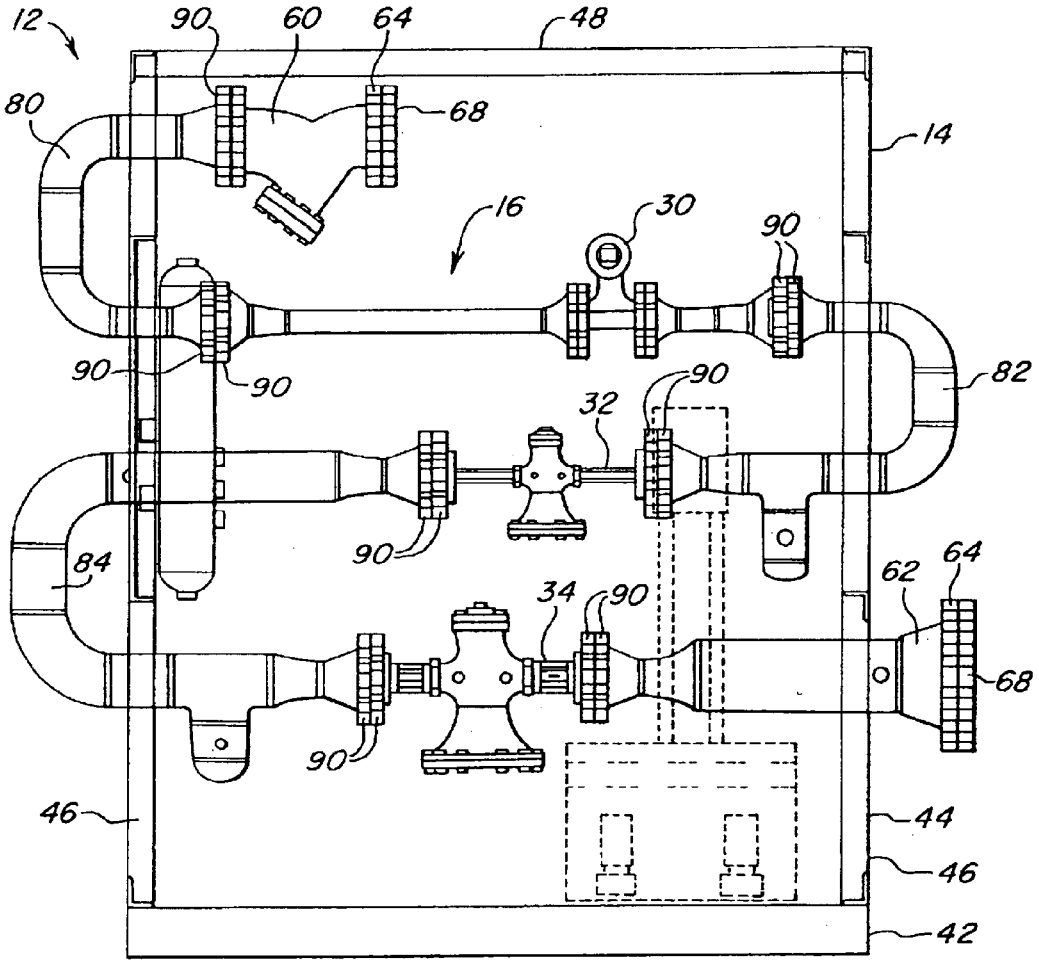
FIG. 2 is a front view of the piping system of FIG. 1 with the spool pieces replaced by metering and valve piping sections.

A metering and pressure reducing piping system 10 according to the present invention is illustrated in FIGS. 1–4. The piping system includes backbone piping 12 mounted on a frame 14 along a flow path from an inlet to an outlet and interchangeable, configurable piping sections 16 that are attachable between sections of the backbone piping along the flow path. The backbone piping and the frame remain unchanged regardless of the application, while the configurable piping sections are initially provided at the factory as standardized spool pieces 20, 22, 24, illustrated in FIG. 1. The spool pieces are replaced with the desired piping sections 30, 32, 34 at the site, illustrated in FIG. 2.

In the embodiment described herein, which is suitable for district steam metering and delivery, the topmost piping section 30 is a metering section to measure the flowrate of steam to the site. The middle piping section 32 and the lowermost piping section 34 are pressure reducing sections incorporating pressure reducing valves to reduce the high pressure in the distribution piping, for example, 125 psi, to a lower pressure suitable for use at the site, for example, no greater than 15 psi. Two valves are often required to achieve this pressure reduction, although, depending on the type of pressure reducing valve selected, one valve may be sufficient.

The frame 14 preferably has a box-like form. A skid or other plate structure 42 rests on the floor. A rack 44 is supported on the skid. In the embodiment shown, the rack includes four vertical members 46 that extend upwardly from the corners of the skid 42. The upper ends of the vertical members are tied together with four horizontally extending members 48, and crossbars 50 interconnect the short sides of the rack. The frame is preferably formed from steel for strength. Additional structural members or another structural configuration for the frame may be used. The frame with the backbone piping system supported thereon is preferably sized to be moved by a forklift or standard pallet jack through standard door openings, which are 32 inches by 78 inches, and into freight elevators. In a suitable embodiment, the frame is 60 inches long, 30 inches deep on the sides, and 75 inches high. See FIG. 3. The backbone piping may protrude from the short sides, but preferably not from the long sides of the frame.

The backbone piping 12 is sized to provide the desired minimum and maximum flowrates for the range of operation of a particular application. For example, a system can be designed to meter and deliver flowrates from 0 to 5500 lb/hour. Also, two piping systems can be arranged in parallel. Using one or two systems of this size, a majority of district steam customers can be serviced. Alternatively, larger system can be designed to meter and deliver flowrates up to 12,000 lb/hour, which can accommodate almost all district steam customers.

Figure 3:
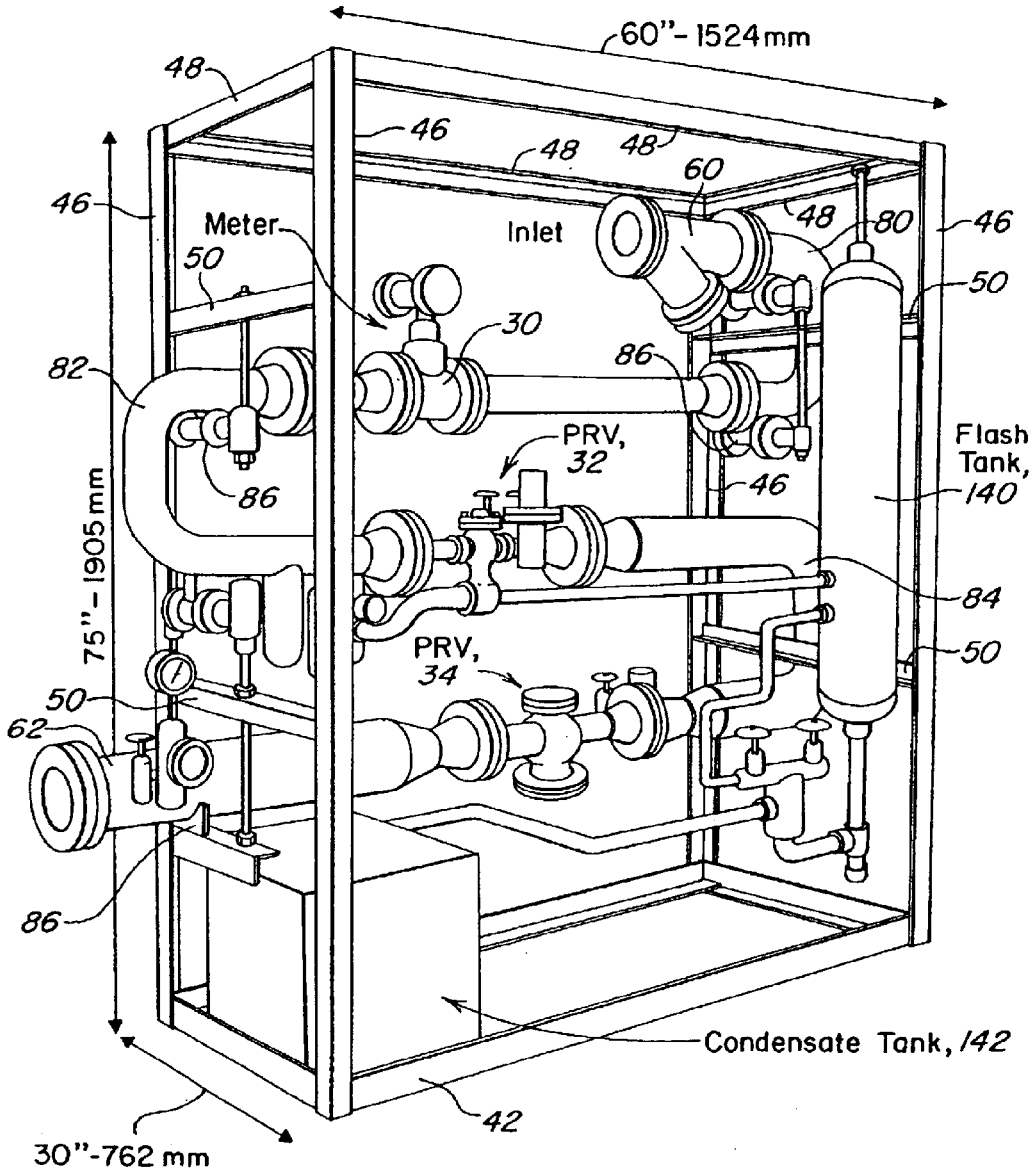
FIG. 3 is a perspective view of the piping system of FIG. 2 with secondary piping also illustrated.
Figure 4:
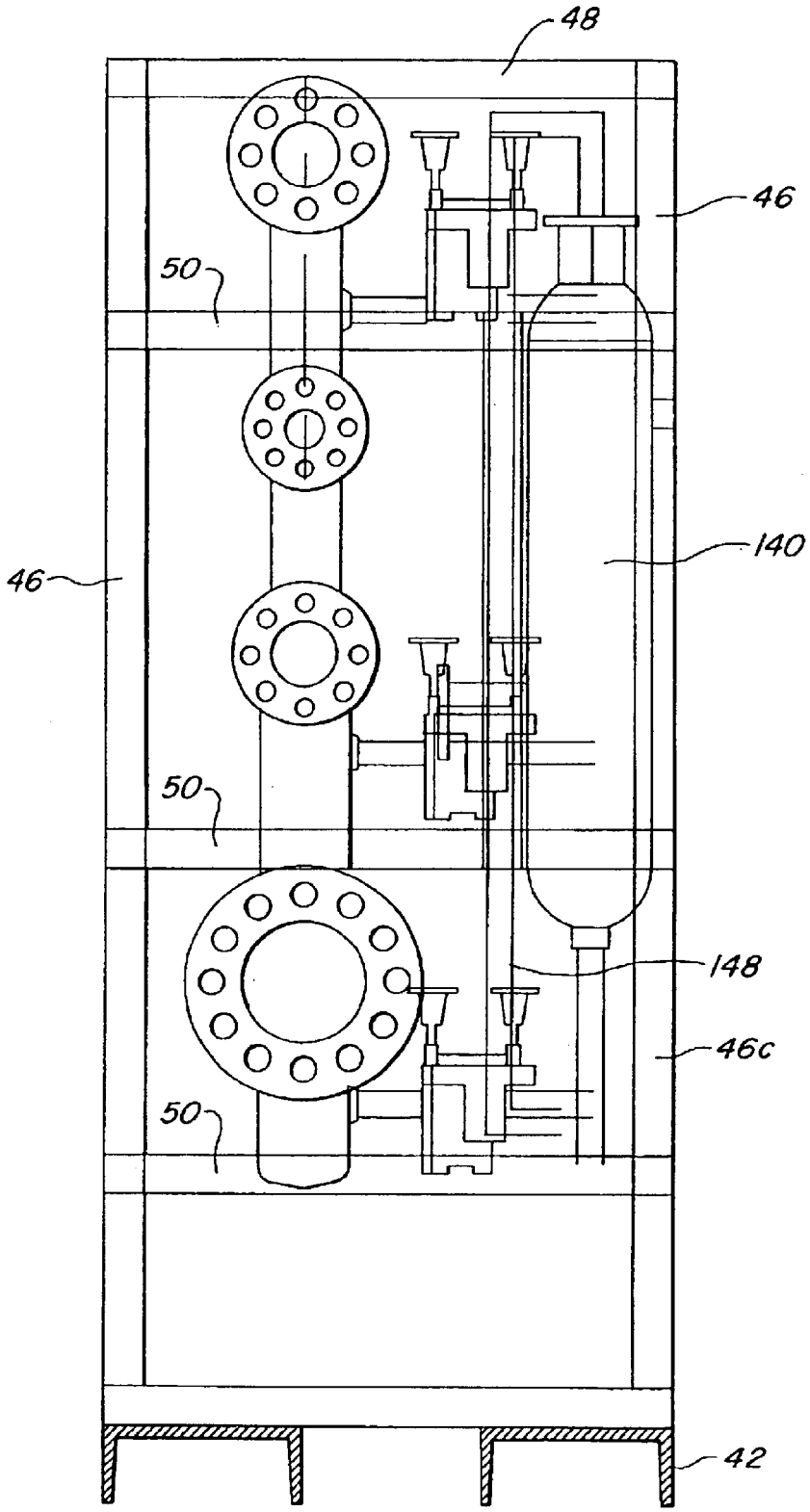
FIG. 4 is a side view of the piping system of FIG. 2.

The backbone piping 12 includes a high pressure inlet connection 60 near the top and a low pressure outlet connection 62 near the bottom. The inlet and outlet connections terminate with flanges 64 and, for shipping, are closed off by shipping flanges 68 that fit against and are fastened to the flanges 64. The backbone piping also includes two high pressure connecting piping sections 80, 82, and a medium pressure connecting piping section 84 that are supported by the frame 14. The connecting piping sections are generally U-shaped to connect the vertically arrayed configurable piping sections 20, 22, 24 or 30, 32, 34 in series to each other and to the inlet connection 60 and the outlet connection 62. The connecting piping sections 80, 82, 84 are mounted to the frame in any suitable manner, such as with pipe hangers or supports 86 attached to the crossbars 50 on the sides of the rack (FIG. 3).

Specially machined interface flanges 90 are provided on the ends of each connecting section 80, 82, 84 and on the ends of each configurable piping section 20, 22, 24, and 30, 32, 34. The interface flanges are standardized or common so that they all have the same outer diameter and can be fastened to each other in abutting contact in known manner using fastening members such as bolts and nuts. Gaskets (not shown) are provided between abutting flanges during use, as is known in the art. During fabrication, blank interface flanges for the desired piping sections are drilled and tapped to accept threaded pipe lengths of a selected diameter, for example, 2 inches or 2.5 inches, as described further below.

Figure 11:
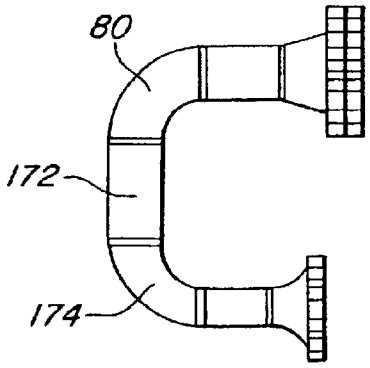
FIG. 11 is a side view of a high pressure connecting piping component.
Figure 12:
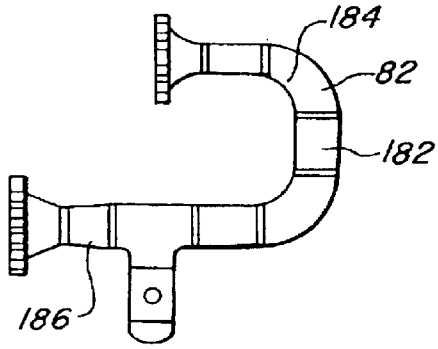
FIG. 12 is a side view of a further high pressure connecting piping component.
Figure 13:
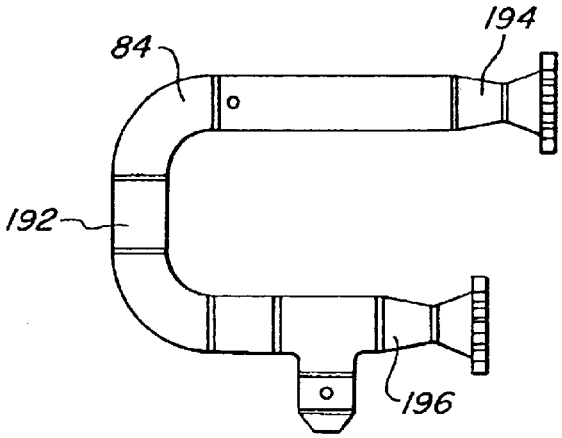
FIG. 13 is a side view of a medium pressure connecting piping component.

In an example of a backbone piping system suitable for flow rates from 0 to 5500 lb/hour, the high pressure connecting piping section 80 is a U-shaped component with 3-inch diameter section of pipe 172 and a 3-inch to 2-inch diameter reducing section 174 at the outlet for connecting to the metering section 30. See FIG. 11. The high pressure connecting piping section 82 is a U-shaped component with a 3-inch diameter section of pipe 182, a 3-inch to 2-inch reducing section 184 for connecting from the metering section 30 at the inlet, and a 3-inch to 2.5-inch reducing section 186 for connecting to the pressure reducing section 32 at the outlet. See FIG. 12. The medium pressure connecting piping section 84 is a U-shaped component with a 4-inch diameter section of pipe 192, a 4-inch to 2.5-inch reducing section 194 for connecting from the pressure reducing section 32 at the inlet, and a 4-inch to 2.5-inch reducing section 196 for connecting to the pressure reducing section 34 at the outlet. See FIG. 13.

In the embodiment illustrated, three interchangeable or configurable piping sections 20, 22, 24, and 30, 32, 34 are arrayed vertically within the frame. Each configurable section extends horizontally from a connecting piping section at one side of the frame to a connecting piping section at the other side of the frame along the flow path from the inlet to the outlet. The bottommost configurable section 24 or 34 extends between the connecting piping section 84 and the outlet connection 62. It will be appreciated that another number of configurable piping sections could be provided.

As noted above, for shipping to the site, the configurable sections are in the form of spool pieces 20, 22, 24 inserted in the frame 14. The spool pieces are straight lengths of pipe 21, 23, 25 that terminate with the common interface flanges 90. Suitable gaskets are placed on the flanges.

In the embodiment illustrated, which is suitable for district steam metering and delivery, the topmost section 20 or 30 of the three sections is intended to be a metering section, in which a flowmeter is insertable. The middle section 22 or 32 and the bottom section 24 or 34 are intended to be valve sections, in which pressure reducing valves are insertable. For the metering and delivery of steam, it has been determined that a suitable standard length for the metering section 30 and its corresponding spool piece 20 is 48.5 inches and a suitable diameter is 2 inches. This length is sufficient to accommodate meters that require a certain length of pipe before and after the meter to measure the flow rate. A suitable standard length for the valve sections 32, 34 and their corresponding spool pieces 22, 24 is 18 inches and a suitable diameter is 2.5 inches. This length accommodates most commercially available pressure reducing valves suitable for district steam distribution. It will be appreciated that the standard lengths and diameters may be selected as appropriate for the desired application.

Figure 5:
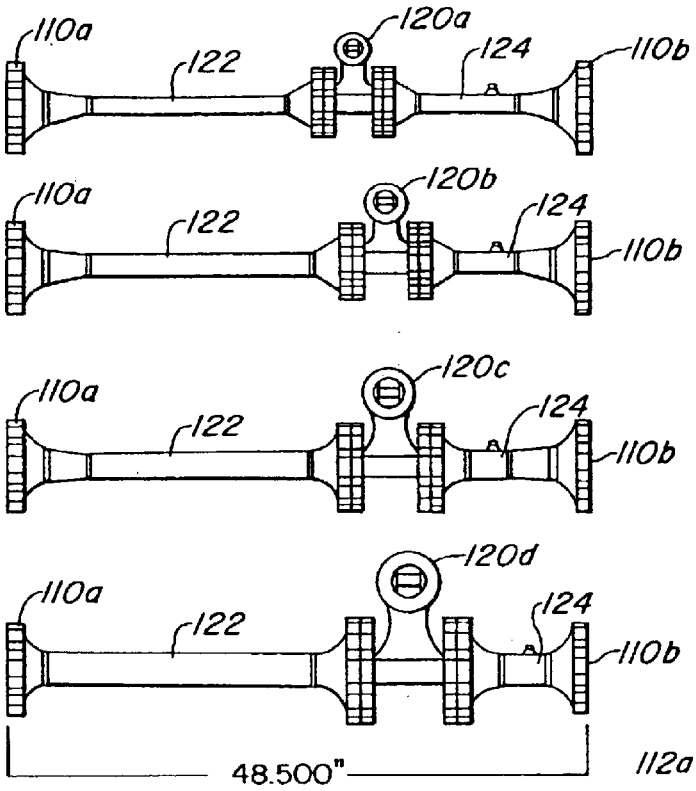
FIG. 5 is a front view of a variety of metering piping sections.

For insertion into the topmost metering section, any desired size and configuration of flowmeter from any desired manufacturer may be selected, as determined by the customer's requirements. FIG. 5 illustrates a variety of vortex meter configurations 120*a-d* that are insertable in the metering section. For example, meter 120*a* may meter up to 500 lb/hour, be 5.00 inches long and have a ½-inch diameter inlet and outlet and flanged or threaded ends, whereas meter 120*d* may meter up to 5600 lb/hour, be 6.58 inches long, and have a 2-inch diameter inlet and outlet and flanged or threaded ends. At the factory, upstream and downstream piping pieces 122, 124 are fitted in any suitable manner to the input and output faces of the selected meter. Blank interface flanges 90 are appropriately drilled and tapped and attached to the threaded ends of the piping pieces 122, 124. The interface flanges 90 are thus attachable to the interface flanges 90 on the backbone piping. The overall length of the meter with the upstream and downstream piping pieces is the same as the length of the meter spool piece. In this manner, the interface to the system occurs not at the meter but at the common interface flanges, allowing any selected make, size and configuration of meter to be installed in the piping system.

Figure 6:
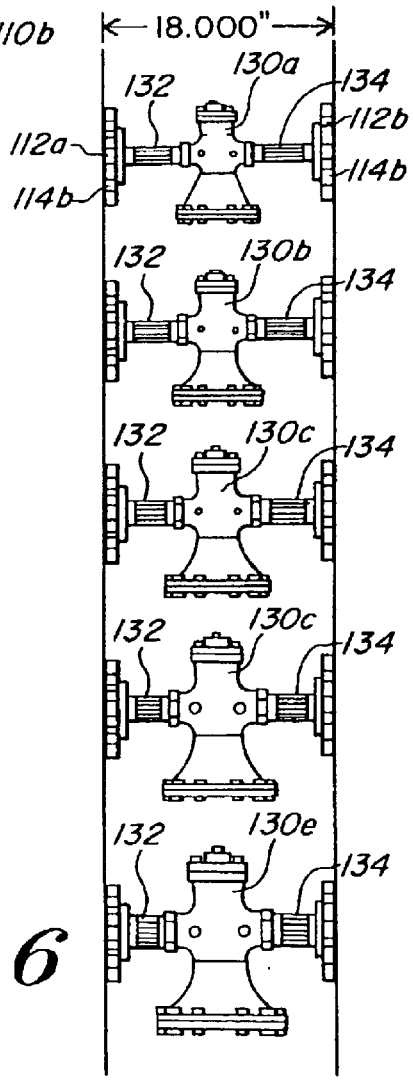
FIG. 6 is a front view of a variety of pressure reducing valve piping sections.

Similarly, any desired size and configuration of pressure reducing valve from any desired manufacturer may be selected for insertion into the valve sections, as determined by the customer's requirements. FIG. 6 illustrates a variety of pressure reducing valve configurations 130*a-e* that are insertable in the valve sections. For example, valves may have inlet and outer diameters ranging from ¾ inch to 2 inches. At the factory, upstream and downstream piping pieces 132, 134 are fitted in any suitable manner to the input and output faces of the selected valve. Blank interface flanges are appropriately drilled and tapped and attached to the threaded ends of the piping pieces. The interface flanges 90 are thus attachable to the interface flanges 90 on the backbone piping. The overall length of the valve with the upstream and downstream piping pieces is the same as the standard length of the valve spool piece. In this manner, any make, size and configuration of pressure reducing valve may be prepared for installation into the piping system without affecting the backbone piping.

Figure 7:
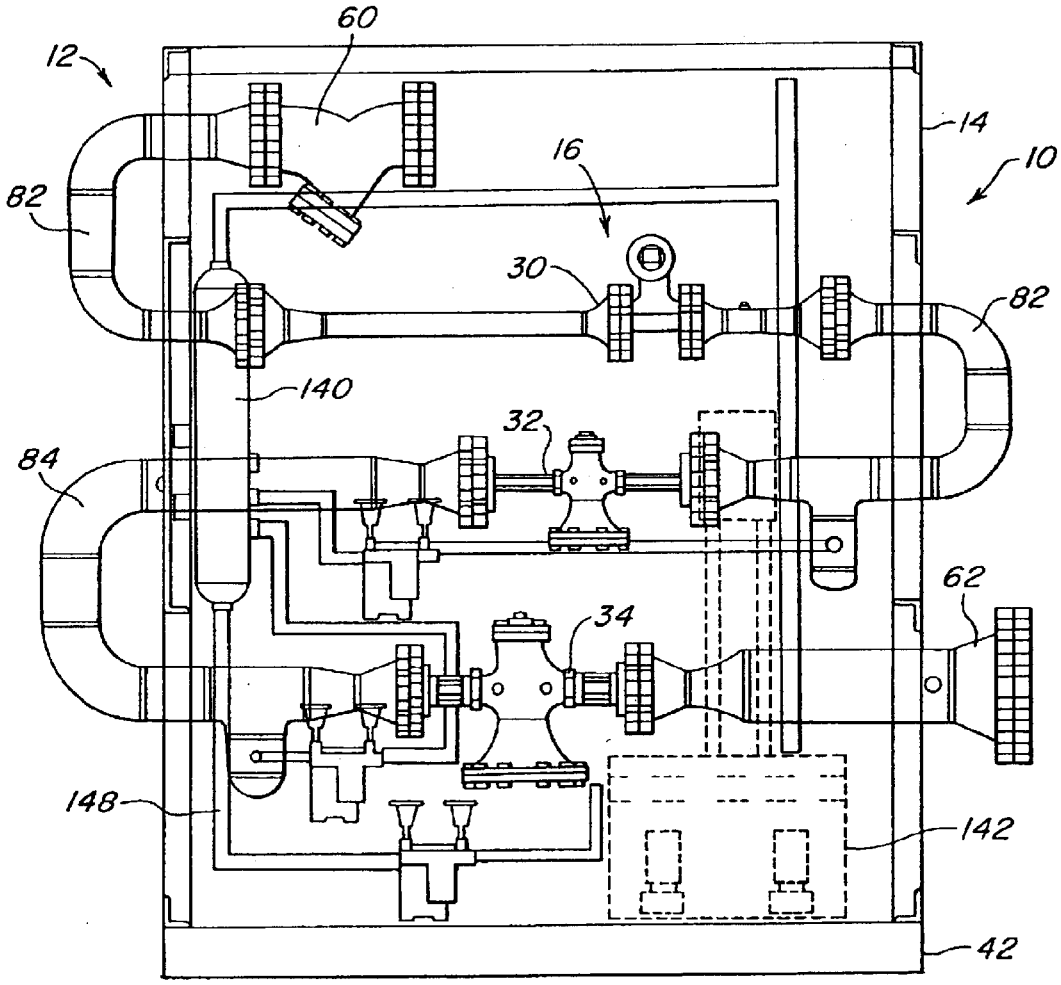
FIG. 7 is a front view of the piping system of FIG. 2 with secondary piping also illustrated.

The piping system is typically prefabricated with other components that may be necessary for a particular system, such as a flash tank 140, a condensate tank 142, traps and connections for building traps, and necessary secondary piping 140 for these components, as would be known in the art. These components can be readily selected and assembled to conform to the site and are attached to the frame. FIG. 7 illustrates a system with a typical arrangement of these other components.

As noted above, the piping system 10 is prefabricated with the spool pieces 20, 22, 24 inserted between the connecting piping sections 80, 82, 84. The piping system is delivered to the site in this form ready for installation. At the site, the frame 12 is located in position on any structurally sound surface without the need for a housekeeping pad. If site conditions are particularly complex, the piping system can be disassembled for shipping and reassembled at the point of use. The shipping flanges 66 are removed from the inlet and outlet connections 60, 62. The inlet connection is connected to the external steam source and the outlet is connected to the piping at the site. The piping system is then blown down with steam to remove any welding slag in the service line. The temporary meter spool piece is removed and the desired meter piping section 30 is inserted. Next, the two temporary pressure reducing valve spool pieces are removed, and the desired pressure reducing valve piping sections 32, 34 are inserted. If only a single pressure reducing valve is needed, the spool piece for the second valve is left in position within the frame. The connecting piping sections 80, 82, 84 can be slid horizontally outwardly on their supports to allow insertion of the desired piping sections and slid back to connect to the desired piping sections. The condensate tank, if present, is connected to the condensate drain.

Figure 8:
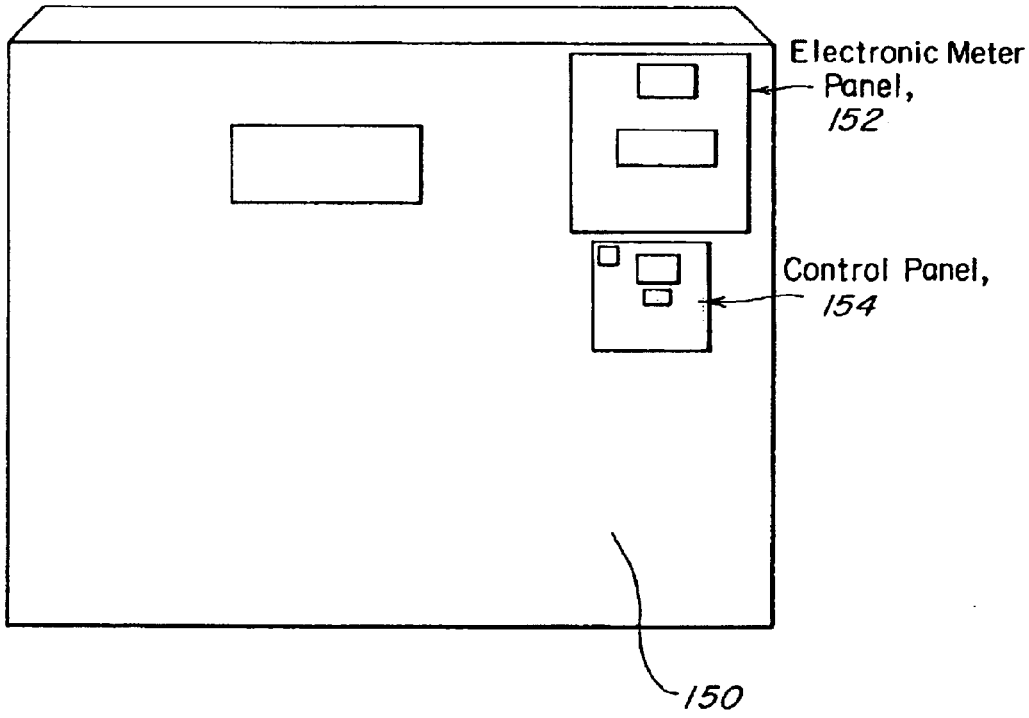
FIG. 8 is a front view of the piping system in a protective enclosure.

An enclosure 150 may be provided surrounding the piping system. See FIG. 8. The enclosure is formed by side and top panels attached to the frame in any suitable manner. A front panel is removable for access to the equipment within. The enclosure is particularly useful on rooftops or in hazardous areas. The enclosure also provides thermal isolation and noise suppression.

An electronic meter panel 152 and control panel 154 are attachable to the frame or to the enclosure surrounding the system. The electronic controls provide electrical communication to the meter and the pressure reducing valves, as known in the art. The control panel can include any desired energy management functions, such as time, temperature, setback, trap status and valve control.

Figure 9:
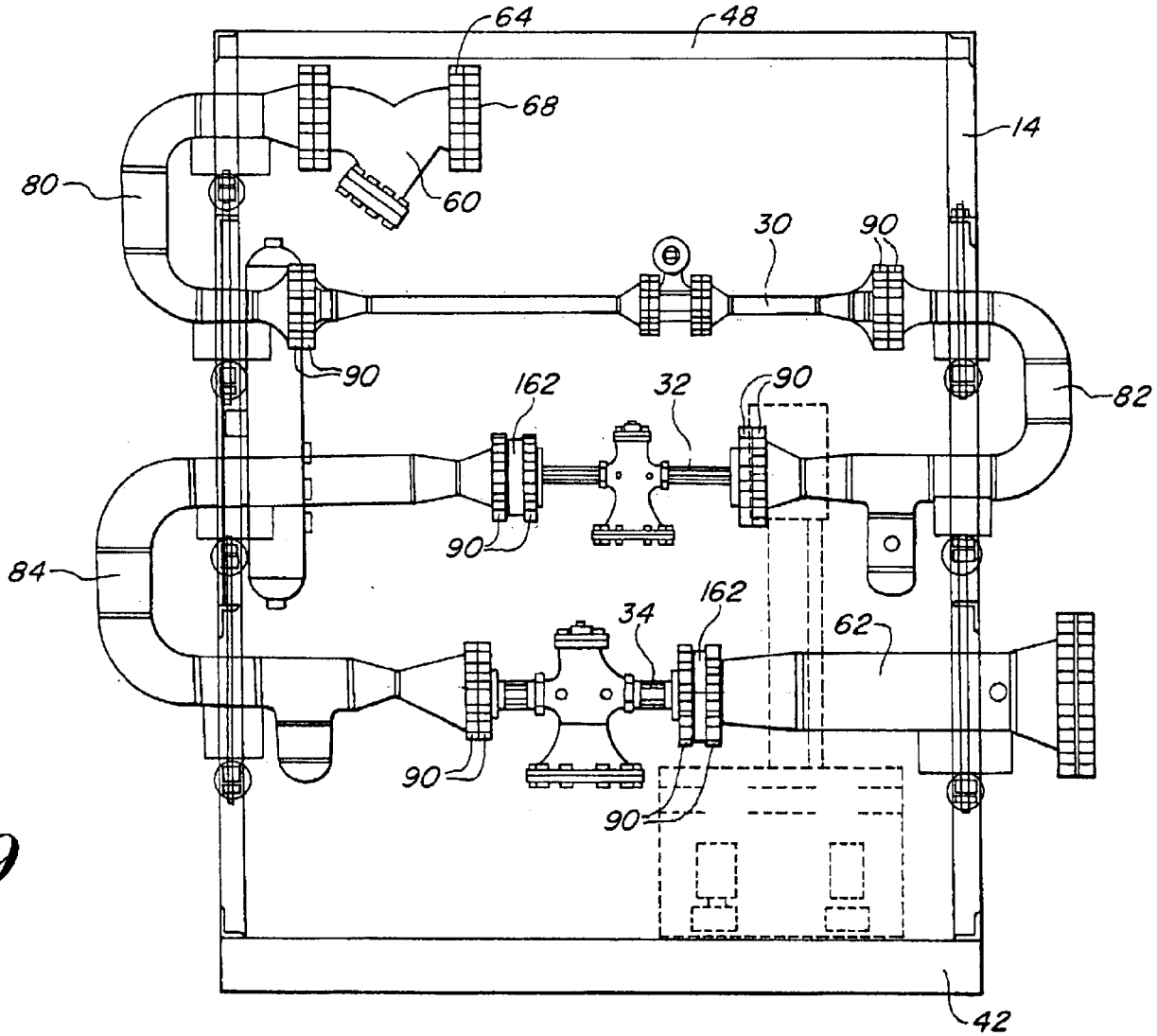
FIG. 9 is a front view of a piping system incorporating muffling orifice plates.
Figure 10:
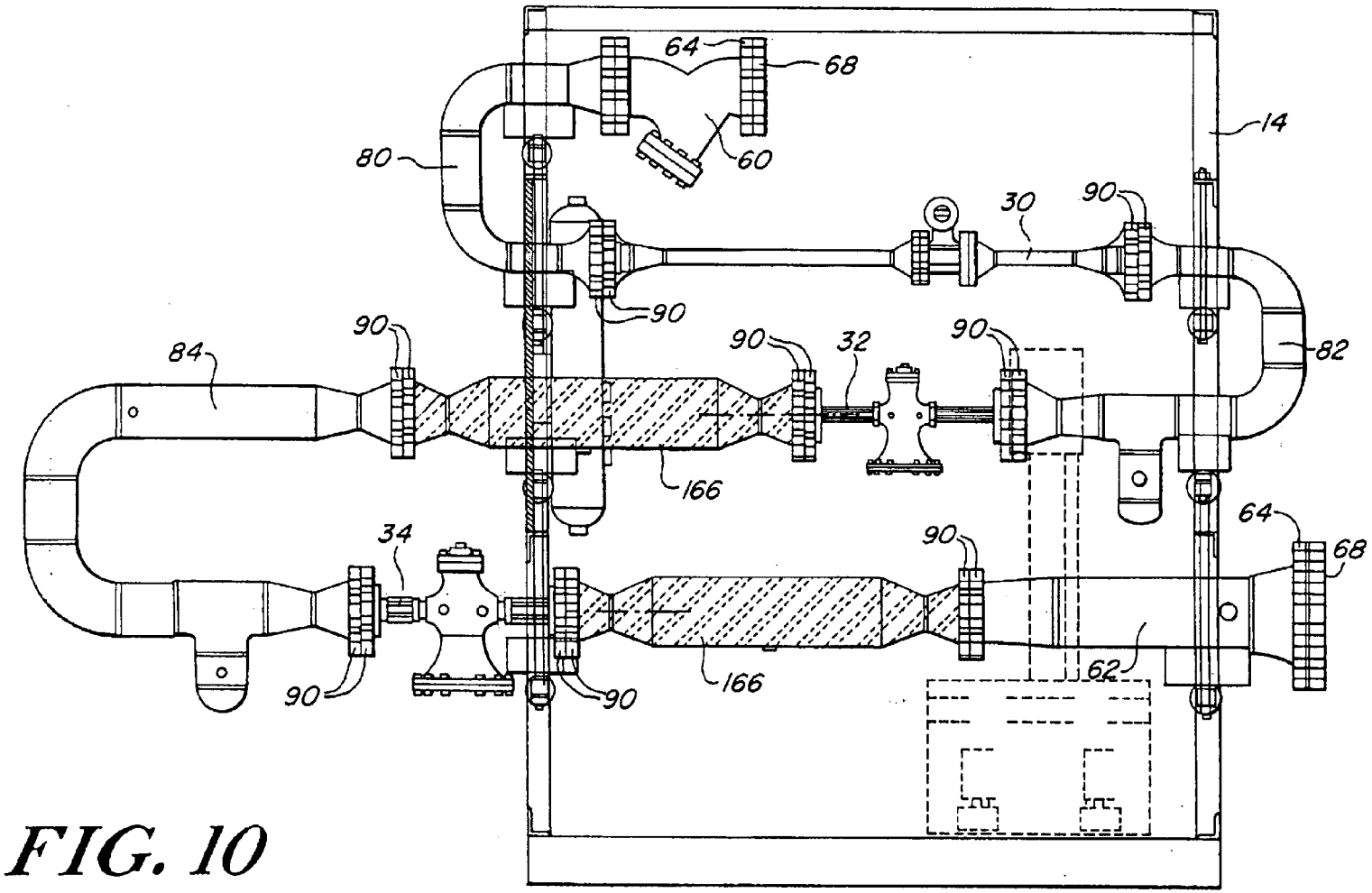
FIG. 10 is a front view of a piping system incorporating noise suppressor components.

Other components may be added to the piping system, if desired. For example, the piping system may be fitted with a shell and tube heat exchanger for hydronic heat or with a horizontal domestic hot water heater. These components may be mounted to the top of the piping system and connected to fittings included in the system. Noise suppression equipment such as muffling plates or suppressors may be included if desired without changes to the piping system as long as both pressure reducing valve sections are fitted with the same device to retain the same overall length. FIG. 9 illustrates muffling orifice plates 162 inserted downstream of both pressure reducing valve sections. FIG. 10 illustrates noise suppressor components 166 inserted downstream of both pressure reducing valve sections. The suppressor components include common interface flanges 90 on their ends. In each case, the noise suppression devices are inserted by sliding the medium pressure connecting piping section 84 to the side to accommodate the added length of the noise suppression device.

The piping system is suitable for use in many locations, such as hospitals, universities, and industrial complexes that utilize central heating and cooling plants. The piping system can be used as a temporary unit if desired. A temporary piping system may be desirable to provide heat at a construction site or during a power outage.

Installation of the piping system at the site requires less skilled labor and time than custom fabrication at the site. Often, the system can be installed in one day. By prefabricating the frame, the backbone piping, and the meter and pressure reducing valve piping sections in a factory environment, the quality of the piping system can be improved. In the factory environment, the quality of the piping welds can be more carefully controlled. If X-ray weld analysis is required, the welds can be X-rayed without delay at the time of fabrication. Pipe alignment can be accurately controlled through the use of fabrication jigs. The system can be assembled without piping changes in either a left-hand or a right-hand configuration.

During the life of the system, the meters can be replaced with other meters at the site without concern for the piping design. Similarly, pressure reducing valves can be removed and replaced as necessary. The entire piping system can also be removed from a particular site and reinstalled at another site, whereas custom piping systems must either be abandoned in place or disposed of. The piping system can be relocated and reused in the same or different configurations and with the same or different flowrates by installation of the appropriate meters and valves.

The invention is not to be limited by what has been particularly shown and described, except as indicated by the appended claims.

What is claimed is:

1. A fluid metering and distribution piping system comprising:

a frame;

backbone piping supported by the frame, the backbone piping comprising connecting piping sections discretely disposed along a flow path from an inlet to an outlet;

interchangeable piping sections attachable to the backbone piping between connecting piping sections on the flow path, comprising:

a plurality of spool pieces, a flowrate metering section having a common length with at least one of the spool pieces, wherein the metering section is interchangeable with the at least one spool piece, and at least one pressure reducing valve section attachable to the backbone piping on the flow path downstream of the high pressure metering section and having a common length with at least another of the spool pieces, wherein the valve section is interchangeable with the at least another spool piece.

2. The system of claim 1, wherein interfaces between the interchangeable piping sections and the connecting piping sections comprise commonly configured abutting interface flanges.

3. The system of claim 1, wherein the frame is configured to be lifted by a forklift or a pallet jack.

4. The system of claim 1, wherein the frame and backbone piping are sized to pass through openings that are 32 inches wide by 78 inches high.

5. The system of claim 1, wherein the frame comprises a bottom plate and an upstanding rack.

6. The system of claim 5, wherein the rack comprises support members upstanding from the bottom plate and crossbars on opposed sides of the rack, and the connecting piping sections are attached to the crossbars.

7. The system of claim 1, wherein the connecting piping sections of the backbone piping are generally U-shaped and include an inlet end and an outlet end, and are attached to the frame with the inlet end above the outlet end.

8. The system of claim 1, wherein each of the interchangeable piping sections extends horizontally within the frame in a vertical array.

9. The system of claim 1, wherein:

the connecting piping sections comprise a first connecting piping section attached to an inlet connection, a second connecting piping section and a third piping section; and the interchangeable piping sections comprise sections connected between the first connecting section and the second connecting section, between the second connecting section and the third connecting section, and between the third connecting section and an outlet connection.

10. The system of claim 1, wherein the backbone piping, the metering section, and the pressure reducing valve section are sized to distribute steam from a district steam distribution system to a selected site at a selected pressure reduced from a distribution system pressure within a selected flowrate range.

11. The system of claim 1, wherein the metering section is configured to meter steam flowrates.

12. The system of claim 1, wherein the pressure reducing valve section is configured to reduce the pressure of steam.

13. The system of claim 1, wherein the metering section is disposable upstream of the at least one valve section.

14. The system of claim 1, further comprising an enclosure surrounding the frame and the backbone piping.

15. The system of claim 1, further comprising an electronic control panel disposed to provide electrical communication to the piping system.

16. The system of claim 1, further comprising a flash tank supported by the frame.

17. The system of claim 1, further comprising a condensate tank supported by the frame.

18. The system of claim 1, further comprising at least two pressure reducing valve sections attachable to the backbone piping on the flow path downstream of the metering section and having a single common length with at least two others of the spool pieces, wherein the valve sections are interchangeable with the at least two other spool pieces.

19. The system of claim 18, further comprising noise suppression devices attachable to each of the at least two pressure reducing valve sections, the noise suppression devices increasing the single common length by a common amount, one of the connecting piping sections horizontally slidable by the common amount to provide space along the flow path for the noise suppression devices.

20. The system of claim 1, further comprising a noise suppression device attachable to the pressure reducing valve section.

21. The system of claim 20, wherein the noise suppression device comprises a muffling orifice plate.

22. The system of claim 20, wherein the noise suppression device comprises a noise suppressor piping component.

23. The piping system comprising:

a frame comprising a bottom plate and an upstanding rack;

backbone piping attached to the frame, comprising:

an inlet connection, an outlet connection, and a plurality of connecting piping sections, interface flanges disposed at ends of the connecting piping sections;

interchangeable piping sections attachable to the backbone piping, comprising:

a plurality of spool pieces each comprising a pipe and interface flanges disposed at the ends of the pipe, at least one metering section comprising a flow meter disposed within a pipe section, and interface flanges disposed at ends of the pipe section, the metering section having a common length with at least one of the spool pieces, wherein the metering section is interchangeable with the at least one spool piece, and at least one valve section comprising a pressure reducing valve disposed within a pipe section, and interface flanges disposed at ends of the pipe section, the valve section having a common length with at least another of the spool pieces, wherein the valve section is interchangeable with the at least another spool piece; and wherein the interface flanges are commonly configured for abutting connection with other ones of the interface flanges.

24. The process of distributing steam to a site comprising:

(a) providing a piping system comprising:

a frame;

backbone piping attached to the frame, comprising connecting piping sections discretely disposed along a flow path from an inlet to an outlet; and a plurality of removable spool pieces attached to the backbone piping;

(b) connecting the inlet to a steam distribution system;

(c) connecting the outlet to piping at the site;

(d) replacing at least one spool piece with a metering section comprising a flow meter disposed within a pipe section, the metering section having a common length with the at least one spool piece; and (e) replacing at least another spool piece with a valve section comprising a pressure reducing valve disposed within a pipe section, the valve section having a common length with the at least another spool piece.

25. The process of claim 24, further comprising providing common interface flanges at interfaces between the connecting piping sections and the spool pieces, the metering section, and the valve section.

26. The process of claim 24, further comprising disposing an enclosure around the piping system.

27. The process of claim 24, wherein the piping system further comprises a condensate tank; and further comprising connecting the condensate tank to a condensate drain.

28. The process of claim 24, wherein step (a) further comprises:

fabricating the piping system at a first location; and transporting the piping system to a desired installation site at a second location.

29. The process of claim 28, wherein the first location comprises a factory location.

* * * * *